US005308076A

United States Patent [19]

Sun

[11] Patent Number: 5,308,076

[45] Date of Patent: May 3, 1994

[54] GOLF BALL WITH POLAR REGION UNINTERRUPTED DIMPLES

[76] Inventor: Donald J. C. Sun, 4521 Ocean Valley La., San Diego, Calif. 92130

[21] Appl. No.: 5,453

[22] Filed: Jan. 19, 1993

[51] Int. Cl.[5] ..... A63B 37/14

[52] U.S. Cl. ..... 273/232

[58] Field of Search ..... 273/232, 235 R; 40/327

[56] References Cited

U.S. PATENT DOCUMENTS

| | | | |
|---|---|---|---|
| 4,141,559 | 2/1979 | Melvin et al. | 273/232 X |
| 4,142,727 | 3/1979 | Shaw et al. | 273/232 |
| 4,560,168 | 12/1985 | Aoyama | 273/232 |
| 4,729,861 | 3/1988 | Lynch et al. | 273/232 X |
| 4,744,564 | 5/1988 | Yamada | 273/232 |
| 4,765,626 | 8/1988 | Gobush | 273/232 |
| 4,804,189 | 2/1989 | Gobush | 273/232 |
| 4,813,677 | 3/1989 | Oak et al. | 273/232 |
| 4,915,389 | 4/1990 | Ihara | 273/232 |
| 4,919,434 | 4/1990 | Saito | 273/235 R |
| 4,921,255 | 5/1990 | Taylor | 273/232 |
| 5,087,048 | 2/1992 | Sun et al. | 273/232 |
| 5,249,804 | 10/1993 | Sanchez | 273/232 |
| 5,253,872 | 10/1993 | Lemons et al. | 273/232 |

FOREIGN PATENT DOCUMENTS

| | | |
|---|---|---|
| 234081 | 2/1987 | European Pat. Off. . |
| 217483 | 4/1987 | European Pat. Off. . |
| 218311 | 4/1987 | European Pat. Off. . |
| 423974 | 4/1991 | European Pat. Off. . |
| 2157959 | 11/1985 | United Kingdom . |
| 2203954 | 11/1988 | United Kingdom . |
| 2205247 | 12/1988 | United Kingdom . |

*Primary Examiner*—George J. Marlo

*Attorney, Agent, or Firm*—William W. Haefliger

[57] ABSTRACT

A golf ball characterized by enhanced flight distance and enhanced aerodynamic symmetry, the ball having a generally spherical surface with patterns of dimples thereon comprising a ball having a main axis and opposite surface polar regions associated with the axis; there being six geodesic lines defining a spherical hexagon bordering each polar region, the axis being at the center of the hexagons; there being at least three groups of dimples associated with each hexagon, all of the dimples of the groups being completely within the spherical hexagon; the dimples of each group having the same diameter, the dimples of one group having diameters $d_1$, the dimples of the second group having diameters $d_2$, and the dimples of the third group having diameters $d_3$, and; the dimples of each group arranged symmetrically about the axis. The geodesic lines intersect to form six like isosceles spherical triangles respectively adjacent the six sides of each hexagon, and there re additional dimples confined by the triangles, with all dimples confined by each triangle being completely with each triangle. Each geodesic line has a length between its opposite ends which is at least 20% of its surface circumference of the golf ball. The golf ball has an equatorial region everywhere spaced from the spherical hexagons and the dimple density per unit area at the equatorial region is greater than the dimple density per unit area in the spherical hexagons.

10 Claims, 2 Drawing Sheets

GOLF BALL WITH POLAR REGION UNINTERRUPTED DIMPLES

BACKGROUND OF THE INVENTION

This invention relates to a golf ball, and more specifically, to a golf ball with the characteristics of improved distance and improved aerodynamic symmetry. The golf ball has a dimpled surface with the dimples arranged on the surface in patterns created by a series of arcs of great circles. The patterns are such as to allow a large percentage of the surface of the ball to be covered by dimples and to maintain aerodynamic symmetry without the need for changing the depth of the dimples in the polar regions of the ball.

It has become general knowledge to those skilled in the art of making golf balls that the passage of the symmetry rule by the United States Golf Association and the Royal and Ancient has had a negative impact on the distance being able to be achieved by a golf ball. Prior to this rule, golf ball development was moving toward more and more of the ball surface being covered by dimples and having only one circumferential path around the surface of the ball which was not intersected by dimples, that being the true "equator" or seam line of the ball. Further, there was an attempt to avoid multiple parallel rows of dimples. The benefits of avoiding non-intersecting circumferential paths and parallel rows of dimples are pointed out in U.S. Pat. Nos. 4,141,559 and in U.S. Pat. No. 4,560,168. Following the teachings of these patents, further developments were made and improvements, such as those described in U.S. Pat. No. 4,729,861, were made.

With the passage of the symmetry rule, the golf ball industry suffered a substantial setback in technology. It was discovered that the golf balls of U.S. Pat. Nos. 4,141,559, 4,560,168, and 4,729,861, as well as others, failed to pass this rule, which requires that the trajectory, distance, and flight time of the golf ball be essentially the same when hit on the equator with an axis through the poles, as when hit on the equator with an axis through the equator.

Numerous attempts have been made to correct the symmetry of the golf ball to allow passage of this requirement. The most popular method of correcting symmetry has been the use of multiple parting lines or dimple-free, great circles on the ball. Numerous patents have been granted on golf balls having four, five, six, seven, and ten great circles, or circumferential pathways, which do not intersect dimples.

Another method of achieving aerodynamic symmetry was disclosed in U.S. Pat. No. 4,744,564, which described a means of reducing the volumes of polar dimples by making the dimples shallower in this area. This allowed the ball to pass symmetry, but created an area of higher aerodynamic drag in the polar region, thus inhibiting the distance the ball would travel.

U.S. Pat. No. 5,087,048 describes another means of achieving symmetry by utilizing a certain number of smaller, deeper, dimples which are located according to specific guidelines. This restricts the designer from utilizing a number of different dimple sizes and results in "clusters" of different sized dimples.

SUMMARY OF THE INVENTION

It is a major object of the invention to provide an improved dimple pattern on a golf ball that avoids the disadvantages and problems associated with prior dimple patterns, as for example are referred to above.

Basically, the improved ball is characterized by the following:

a) the ball having a main axis and a surface polar region associated with the axis, b) there being six geodesic lines defining a spherical hexagon bordering the polar region, the -5 axis being at the center of the hexagon, C) there being at least three groups of dimples associated with the hexagon, all of the dimples of the groups being completely within the spherical hexagon, d) the dimples of each group having the same diameter, the dimples of one group having diameters $d_1$, the dimples of the second group having diameters $d_2$, and the dimples of the third group having diameters $d_3$, and e) the dimples of each group arranged symmetrically about the axis.

Another object is to provide an improved ball wherein the geodesic lines also intersect to form six like isosceles spherical triangles respectively adjacent the six sides of the hexagon, there being additional dimples confined by the triangles, all dimples confined by each triangle being completely within each triangle. As will appear, each of the geodesic lines may have opposite ends that intersect dimples outside the triangles and proximate apices of the triangles. Such length between such opposite ends is typically at least 20% of the surface circumference of the golf ball. The length of the six geodesic lines are equal.

Yet another object is to provide a golf ball that has an equatorial region everywhere spaced from the spherical hexagon, the dimple density per unit area at the equatorial region being greater than dimple density per unit area in the spherical hexagon.

Further objects include the provision of a ball with at least four groups of dimple sizes, all like dimples being of equal depth; and the provision of a ball with an axially opposite polar region like that defined by the spherical hexagon and triangles, and associated dimples, as referred to above.

These and other objects and advantages of the invention, as well as the details of an illustrative embodiment, will be more fully understood from the following specification and drawings, in which:

DRAWING DESCRIPTION

FIG. 1 is a polar view of one hemisphere showing one dimple pattern of the invention, the opposite polar region being the same; and FIG. 2 is another polar view of one hemisphere showing another dimple pattern of the invention, the opposite polar region being the same.

DETAILED DESCRIPTION

Figure 1:
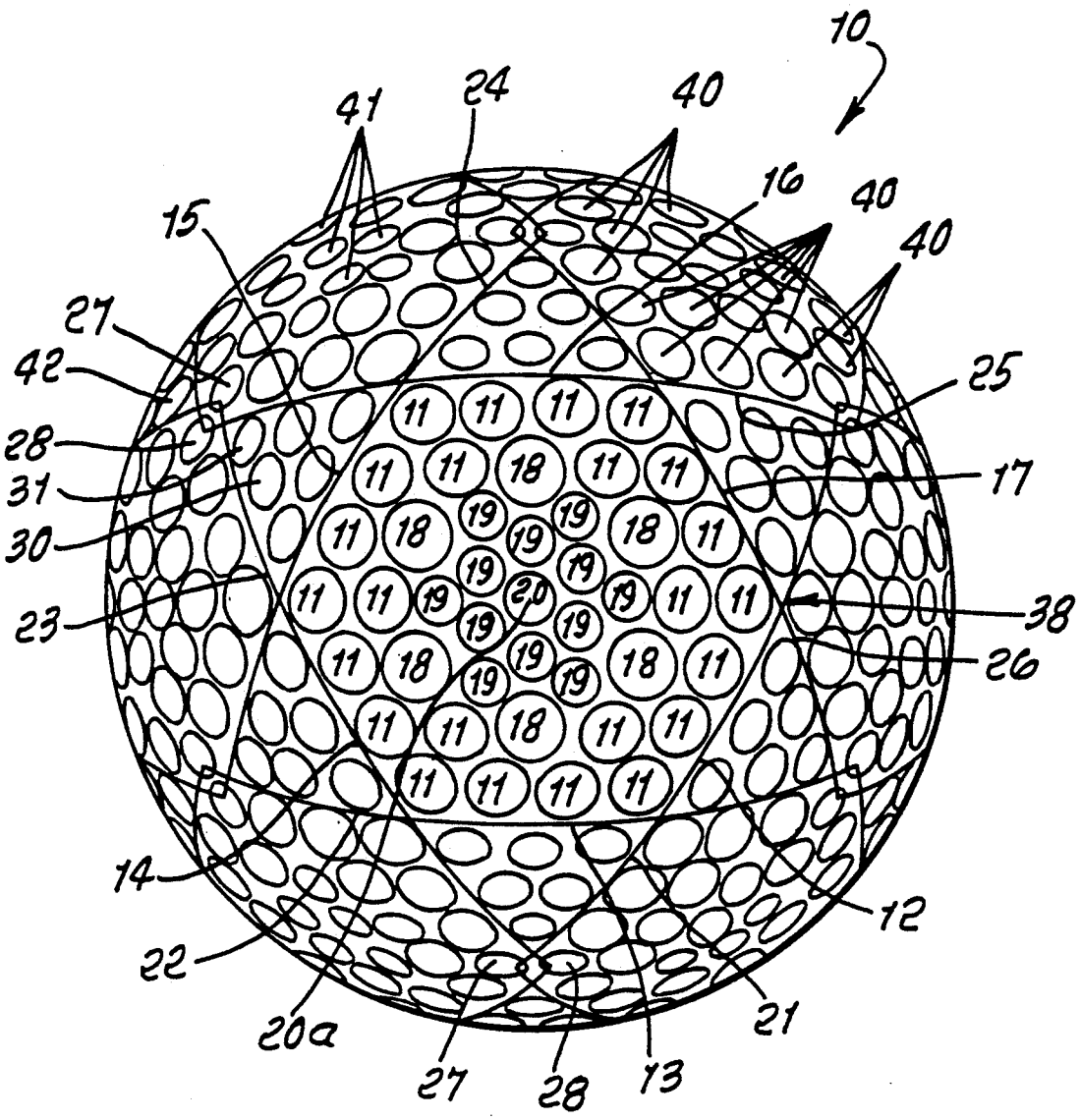

FIG. 1 is a representation of a golf ball 10 containing 518 dimples which is constructed according to the invention. There are four different dimple sizes shown on the ball, and they are interspersed over the entire surface of the ball.

See the twenty-four dimples 11 within the spherical hexagon with sides 12–17, those dimples being closest to sides 12–17, the six larger size dimples 18 within that hexagon, and interspersed between six of the dimples 11 closer to the axis or center **20*a*, the twelve smaller size dimples 19 clustered closer to axis 20*a* and central dimple 20**. These four groups of dimples are within the hexagon, and their sizes are typically as follows:

| | |
|---|---|
| 24 dimples | 11 - .135 ± .002 inches in diameter |
| 6 dimples | 18 - .155 ± .002 inches in diameter |
| 12 dimples | 19 - .106 ± .002 inches in diameter |
| 1 dimple | 20 - .125 ± .002 inches in diameter. |

The main axis 20*a* of the ball passes centrally through the dimple 20, and the polar region containing the described dimples 11, 18, 19, and 20 is within the hexagon.

The solid lines 21–26 represent the geodesics which are used to construct the pattern, 21 defining side 12, 22 defining side 13, 23 defining side 14, etc.. There is no intersection of dimples with the geodesic constraining pattern until the endpoints of the arcs are approached. The last two dimples 27 and 28 toward the endpoints of the geodesics are intersected, with each geodesic terminating in one of the dimples 27 and 28. There are six pairs of dimples 27 and 28. There is no dimple-geodesic intersection in the polar regions, however, for a length equivalent to approximately 23% of the circumference of the sphere, i.e., the length of each geodesic between its ends that intersect dimples 27 or 28. This pattern offers the advantages of having only one circumferential path around the surface of the sphere which is not intersected by dimples, avoidance of multiple parallel rows of dimples, and no constraints requiring dimples on certain areas of the ball to be deeper or shallower than the dimples on other areas of the ball. The reduction of dimple density in the polar region and the smooth partial bands, however, allow the ball to be aerodynamically symmetrical. Dimple chordal depths are between 0.005 and 0.009 inches, depending upon the ball construction, spin rate, etc. Chordal depth is measured from a chordal line across the top of the dimple recess, to the deepest point of the recess bottom.

Figure 2:
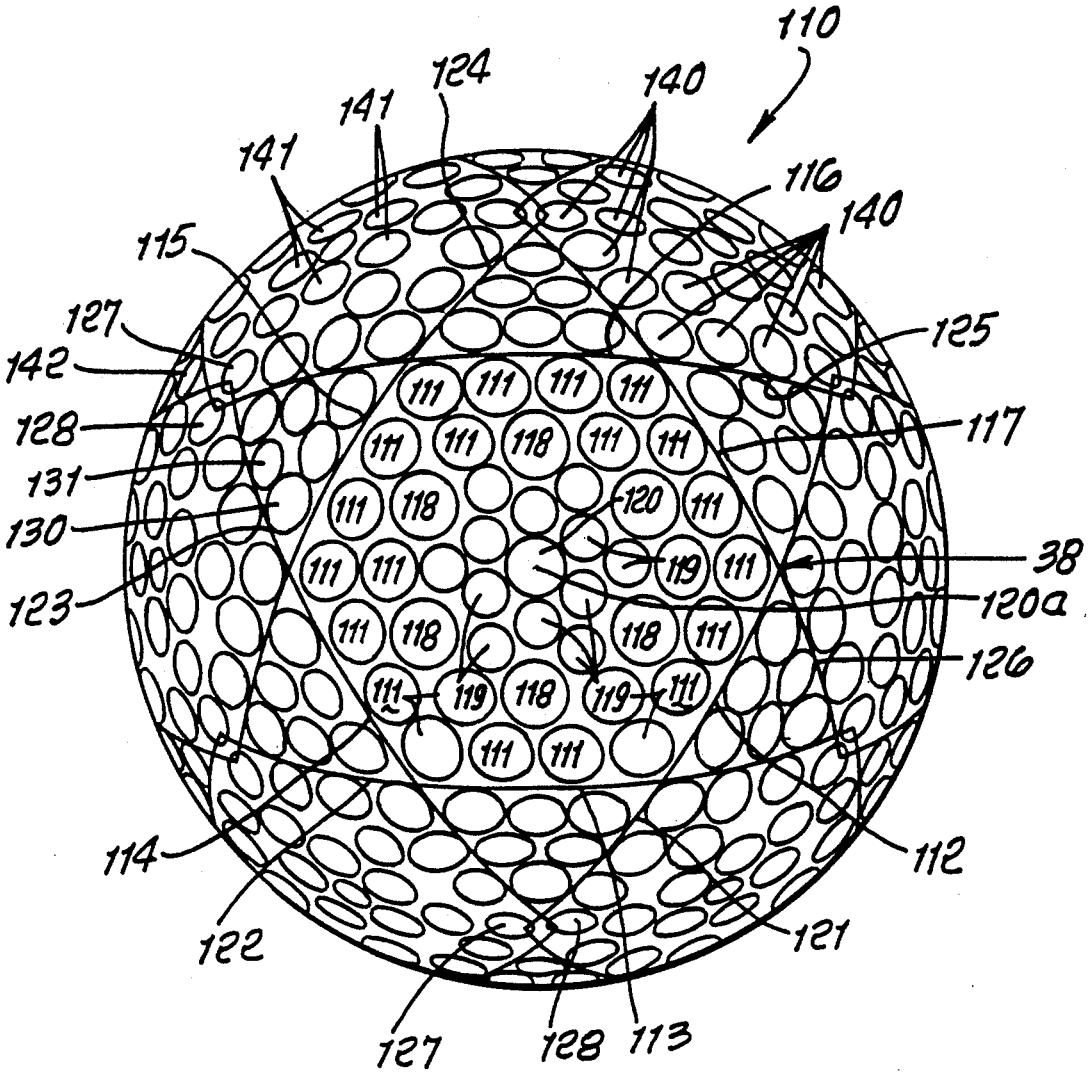

Corresponding elements in FIG. 2 bear identifying numerals, preceded by a "1".

Note also that the geodesic lines also intersect to form six like isosceles spherical triangles respectively adjacent the six sides of the hexagon, there being additional dimples confined by the triangles, all dimples confined by each triangle being completely within each triangle. See, for example, the isosceles triangles formed by:

lines 21, 22 and 23
lines 21, 23 and 24
lines 23, 24 and 25
lines 24, 25 and 26
lines 22, 25 and 26
lines 21, 22 and 26.

These triangles are at the periphery of the hexagon, as shown. There are six dimples in each triangle, as follows:

three dimples 30 0.125±0.002 inches in diameter
three dimples 31 0.106±0.002 inches in diameter.

The intersections of the geodesics with each other is at the corners of the spherical hexagons and is shown as point 38 in both FIG. 1 and FIG. 2, and also occurs at six points on each half of the ball, and occurs essentially at an angle of 54.4° from the equator. By assuring that no dimple intersects these geodesics in the polar region of the ball, and for a distance of at least 20% of the circumference of the sphere, aerodynamic symmetry is achieved.

This achievement can be attributed to two facts. The smooth, dimple-free pathways simulate the effect of the equator of the golf ball in that if they completely circumscribed the sphere, there would be a band of laminar air flow around the entire ball. However, since they do not extend around the entire sphere, a certain amount of turbulence can be created. The degree of this turbulence is controlled by how far up the geodesic toward the polar region dimple-geodesic intersection is allowed to take place. If dimples are allowed to intersect over a large portion of the geodesics, the golf ball will not fly symmetrically. If no dimples intersect any of the geodesics, some distance loss occurs, even though there is still not a dimple-free, great circle other than the true equator. It has been experimentally determined that the geodesics should travel a minimum of at least about 20% of the circumference of the sphere.

The second fact of significance is that, since there is a dimple-free space around each of the geodesics in the polar region of the ball as contrasted with considerable intersection of dimples as one moves toward the equator, the density of dimples per unit area is greater near the equator than near the pole. This is akin to leaving a blank, dimpleless area at the pole, which is an effective means of achieving aerodynamic symmetry. Having a blank, smooth area, however, significantly increases the aerodynamic drag. Spreading this smooth area over a significantly larger surface negates this detrimental effect, while still maintaining the reduced dimple density.

In FIG. 1 there is a total of 518 dimples on the ball, of sizes as follows:

| |
|---|
| 108 dimples - of diameter .106 ± .002 inch |
| 98 dimples - of diameter .125 ± .002 inch |
| 264 dimples - of diameter .135 ± .002 inch |
| 48 dimples - of diameter .155 ± .002 inch. |

In FIG. 2, there is a total of 506 dimples on the ball, of size as follows:

| |
|---|
| 72 dimples - of diameter .106 ± .002 inch |
| 24 dimples - of diameter .122 ± .002 inch |
| 98 dimples - of diameter .125 ± .002 inch |
| 264 dimples - of diameter .135 ± .002 inch |
| 48 dimples - of diameter .155 ± .002 inch. |

The view of the balls of each of FIGS. 1 and 2 from the opposite side is the same as the side shown, i.e., there is a second like hexagonal polar region and six equilateral triangles with the same dimpling as shown in FIGS. 1 and 2.

In FIG. 1, additional dimples as shown, have the following sizes:

| |
|---|
| dimples 40 - of diameter .135 ± .002 inch |
| dimples 41 - of diameter .125 ± .002 inch |
| dimples 42 - of diameter .155 ± .002 inch. |

In FIG. 2, additional dimples as shown, have the following sizes:

| |
|---|
| dimples 140 - of diameter .135 ± .002 inch |
| dimples 141 - of diameter .125 ± .002 inch |
| dimples 142 - of diameter .155 ± .002 inch. |

I claim:

1. In a golf ball characterized by enhanced flight distance and enhanced aerodynamic symmetry, the ball having a generally spherical surface with patterns of dimples thereon, the improvement comprising:

a) the ball having a main axis and opposite surface polar regions associated with said axis, b) there being six geodesic lines defining a spherical hexagon bordering each said polar region, said axis being at the center of said hexagons, c) there being at least three groups of dimples associated with each said hexagon, all of the dimples of said groups being completely within said spherical hexagon, d) the dimples of each group having the same diameter, the dimples of one group having diameters $d_1$, the dimples of the second group having diameters $d_2$, and the dimples of the third group having diameters $d_3$, and e) the dimples of each group arranged symmetrically about said axis, said geodesic lines also intersect to form six like isosceles spherical triangles respectively adjacent the six sides of each said hexagon, there being additional dimples confined by said triangles, all dimples confined by each triangle being completely within each triangle, each said geodesic line having a length between said opposite ends which is at least 20% of its surface circumference of the golf ball, said golf ball having an equational region everywhere spaced from said spherical hexagons, the ball having dimple density per unit area at said equatorial region which is greater than dimple density per unit area in said spherical hexagons.

2. The golf ball of claim 1 wherein there are 518 dimples on said golf ball.

3. The golf ball of claim 1 wherein there are 506 dimples on said golf ball.

4. The golf ball of claim 1 wherein there are four sizes of dimples on said golf ball, as follows:

0.106±0.002 inches in diameter
0.125±0.002 inches in diameter
0.135±0.002 inches in diameter
0.155±0.002 inches in diameter.

5. The golf ball of claim 1 wherein there are
108 dimples that are 0.106±0.002 inches in diameter
98 dimples that are 0.125±0.002 inches in diameter
264 dimples that are 0.135±0.002 inches in diameter
48 dimples that are 0.155±0.002 inches in diameter.

6. The golf ball of claim 1 wherein there are five sizes of dimples on each golf ball, as follows:

0.106±0.002 inches in diameter
0.122±0.002 inches in diameter
0.125±0.002 inches in diameter
0.135±0.002 inches in diameter
0.155±0.002 inches in diameter.

7. The golf ball of claim 1 wherein there are:
72 dimples that are 0.106±0.002 inches in diameter
24 dimples that are 0.122±0.002 inches in diameter
98 dimples that are 0.125±0.002 inches in diameter
264 dimples that are 0.135±0.002 inches in diameter
48 dimples that are 0.155±0.002 inches in diameter.

8. The golf ball of claim 1 wherein there are the following dimples in said spherical hexagon
24 dimples that are 0.135±0.002 inches in diameter
6 dimples that are 0.155±0.002 inches in diameter
12 dimples that are 0.106±0.002 inches in diameter
1 dimple that is 0.125±0.002 inches in diameter.

9. The golf ball of claim 1 wherein each of said geodesics has opposite ends that intersect dimples outside said triangles and proximate apices of said triangles, and wherein the intersected dimples at said geodesic opposite ends have diameters that are 0.155±0.002 inches.

10. The golf ball of claim 1 wherein each of said geodesics has opposite ends that intersect dimples outside said triangles and proximate apices of said triangles, and wherein the intersected dimples of said geodesic opposite ends have diameters that are 0.106±0.002 inches.

* * * * *